US005140712A

United States Patent [19]

Wang-On

[11] Patent Number: 5,140,712

[45] Date of Patent: Aug. 25, 1992

[54] SIPHON-OPERATED WATER TANK FOR A FLUSHING SYSTEM

[76] Inventor: Kwok Wang-On, Flat D, 3rd Floor, No. 172, Wai Yip Street, Kwun Tong, Kowloon, Hong Kong

[21] Appl. No.: 759,153

[22] Filed: Sep. 13, 1991

[51] Int. Cl.[5] ..... E03D 1/14

[52] U.S. Cl. ..... 4/325; 4/415; 4/373

[58] Field of Search ..... 4/324, 325, 415, 373

[56] References Cited

U.S. PATENT DOCUMENTS 3,663,969 5/1972 Younger ..... 4/325
4,268,924 5/1981 Price et al. ..... 4/415 X
4,864,665 9/1989 Toltzman ..... 4/324 X

FOREIGN PATENT DOCUMENTS 2213846 8/1989 United Kingdom ..... 4/324

*Primary Examiner*—Charles E. Phillips
*Attorney, Agent, or Firm*—Morton J. Rosenberg; David I. Klein

[57] ABSTRACT

A water tank for a flushing system of the type having a flap valve fastened in a siphon tube and alternatively controlled by a main control knob and an auxiliary control knob to discharge different volume of water for washing a lavatory bowl, wherein rotating said main control knob causes a siphon tube to operate so as to let water be completely discharged out of the water tank; rotating said auxiliary control knob causes a float to descend with the flushing water and actuate a siphon interruption in the siphon tube so that a reduced volume of water can be discharged out of the water tank for washing a lavatory bowl.

1 Claim, 5 Drawing Sheets

SIPHON-OPERATED WATER TANK FOR A FLUSHING SYSTEM

BACKGROUND OF THE INVENTION

The present invention relates to a water tank siphon operated water tank which can be controlled to discharge different volume of water for washing a lavatory bowl after night soil or urine.

In a flushing system, a water tank is provided to hold a fixed volume of water for washing a lavatory bowl each time after the discharge of night soil or urine by means of the control of a control knob or lever. After flushing, a water supply valve which is controlled by a float bowl is opened to let water flow into the water tank. Using this structure of water tank for washing a lavatory bowl is not economic because same volume of water has to be discharged for washing a lavatory bowl after the discharge of night soil as well as the discharge of urine. Since less amount of water is required for washing a lavatory bowl to use same volume of water for washing a lavatory bowl after the discharge of urine as what has been used in washing a lavatory bowl after the discharge of night soil.

SUMMARY OF THE INVENTION

The present invention has been accomplished under the circumstances in view. It is therefore the main object of the present invention to provide a water tank for a flushing system which can be controlled to lavatory bowl according to the discharge of night soil or urine.

According to the present invention, there is provided a water tank for a flushing system which is generally comprised of a main control knob, an auxiliary control knob, a float movably received in a float holder, a rocker arm to retain said float in place, and a siphon tube for flushing control. Rotating the main control knob causes the siphon tube to suck in water so that water can be completely discharged out of the water tank for washing a lavatory bowl after the discharge of night soil. Rotating the auxiliary control knob causes the main control knob to rotate and simultaneously causes the rocker arm to release the float, and therefore, a fixed volume of water can be discharged out of the water tank for washing a lavatory bowl after the discharge of urine, before the siphonage in the siphon tube is stopped by the float.

DETAILED DESCRIPTION OF THE PREFERRED EMBODIMENT

Figure 1:
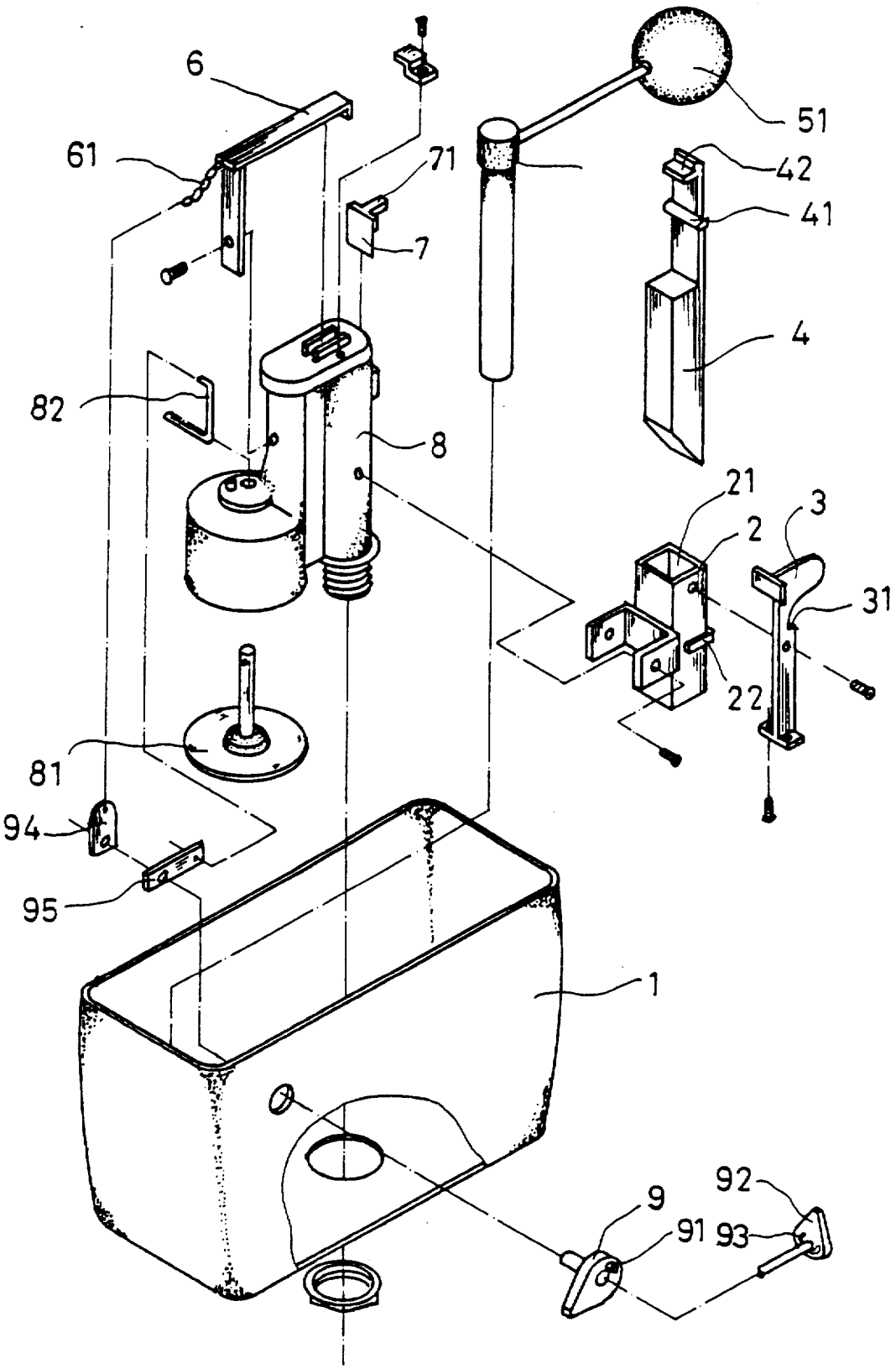
FIG. 1 is an exploded perspective view of the preferred embodiment of the water tank of the present invention.
Figure 2:
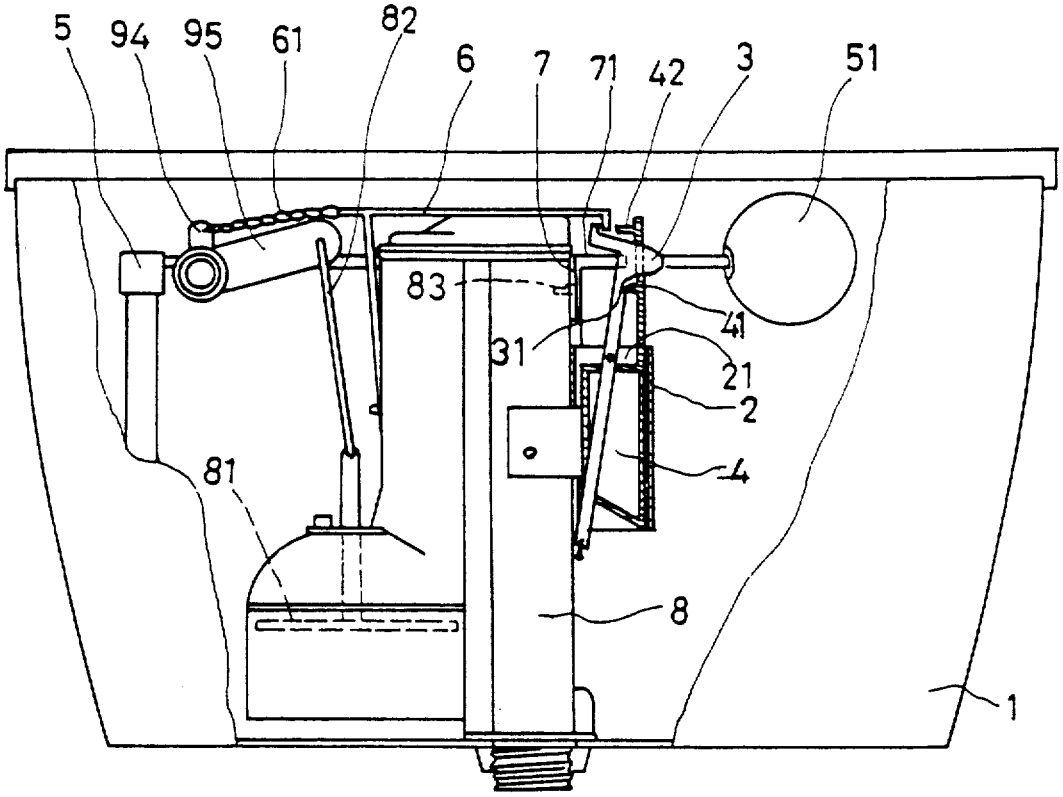
FIG. 2 is a schematic plan view thereof showing that the flap valve has been lifted to let water discharge out of the water tank by means of the control of the main control knob.
Figure 3:
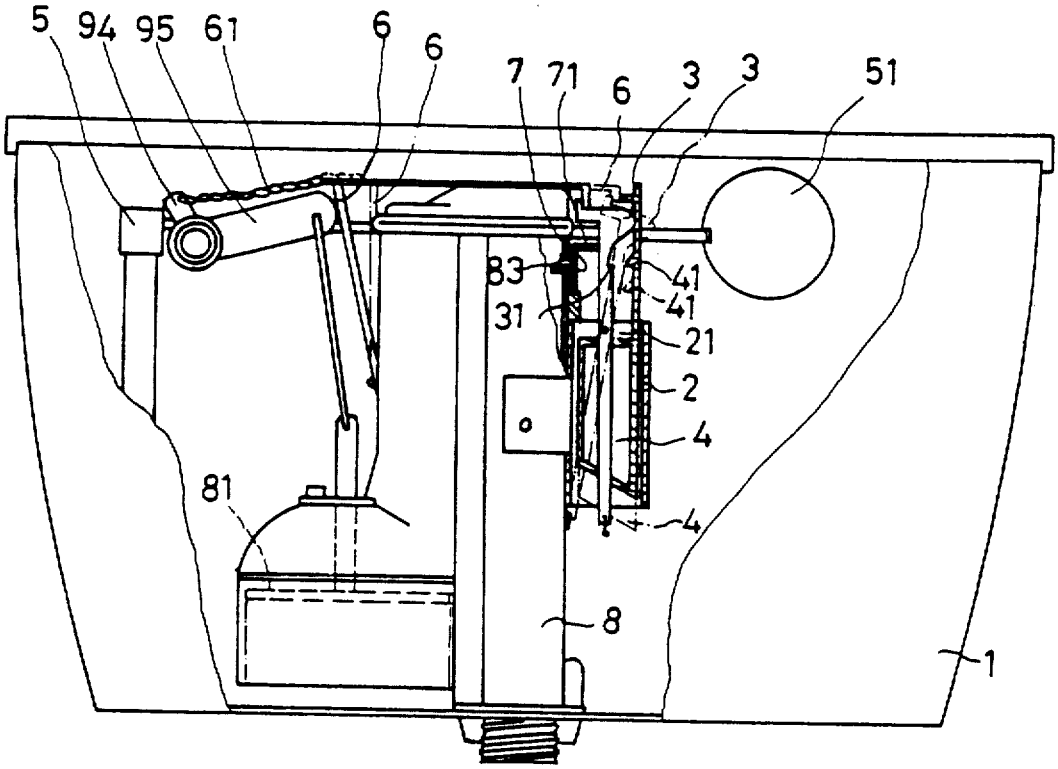
FIG. 3 is another schematic plan view thereof showing that the operation of the auxiliary control knob causes the float to be released from the rocker arm.
Figure 4:
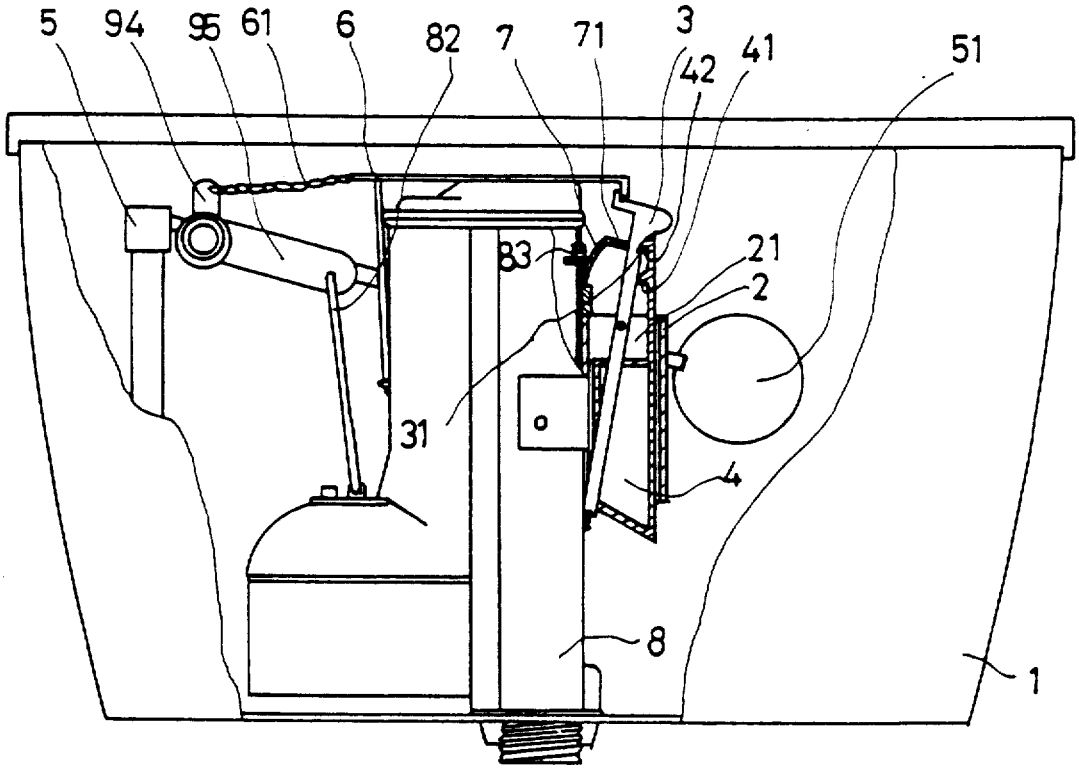
FIG. 4 is still another schematic plan view thereof showing that the float which moves downwards causes the cover plate to open the hole on the siphon tube so that the siphonage is disappeared.
Figure 5:
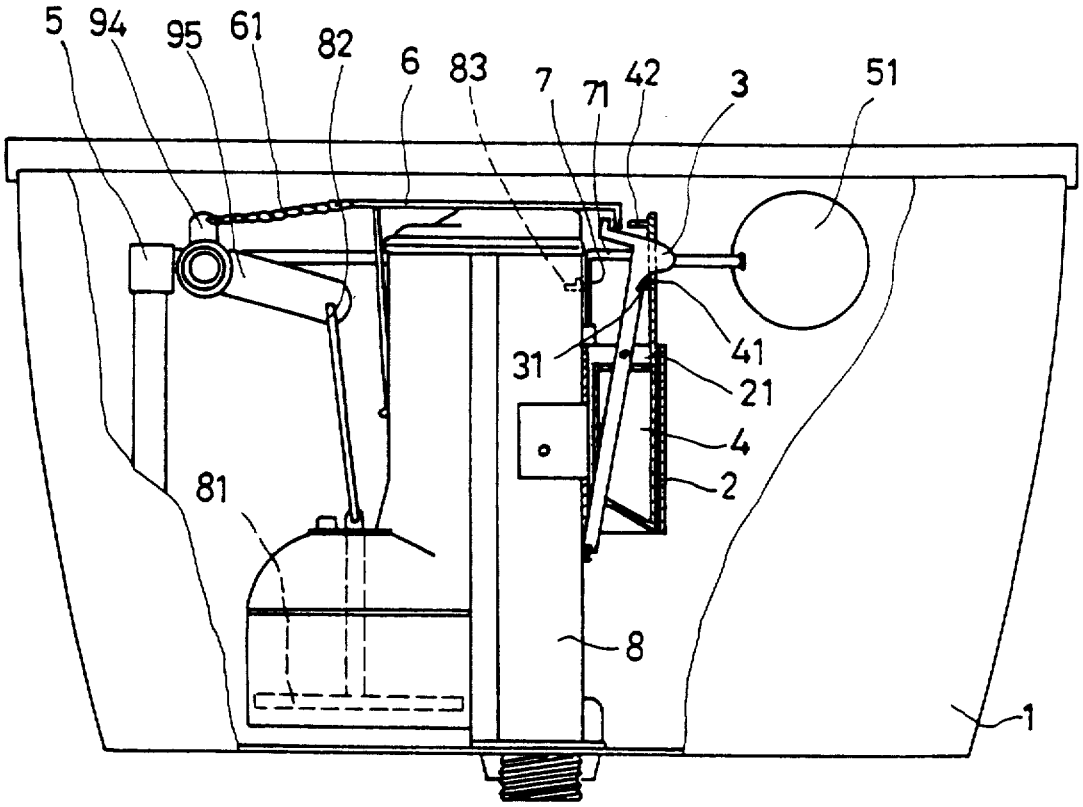
FIG. 5 illustrates the arrangement of the internal parts of the water tank before the operation.

Referring to FIGS. 1, 2 and 3, a siphon tube 8 is fastened inside a water tank 1 with a flap valve 81 which defines therein a guide hole 21 and has a clamp 22 at the outside is secured to the siphon tube 8 at one side. A rocker arm 3 which has a hooked portion 31 at a suitable location is pivoted to the float holder 2 at one side. A float 4 which has a projecting strip 42 at the top and a hooked portion 41 spaced from said projecting strip 42 is movably received in the guide hole 21 inside the float holder 2. In normal condition, the hooked portion 41 on the float 4 is hooked by the hooked portion 31 on the rocker arm 3, and therefore, the float 4 will not fall downwards during each flushing operation. The siphon tube 8 has a hole 83 at one side covered by a resilient cover plate 7 which has a side strip 71 at one side. Under normal condition, the cover plate 7 seals off the hole 83 on the siphon tube 8, and therefore, siphonage can be achieved in the siphon tube 8. There is provided a spring plate 6 at regular angle which has one end free end disposed above the top edge of the siphon tube 8. The spring plate 6 is connected to a link 94 via a chain 61, which link 94 is coupled to an auxiliary control knob 92. The auxiliary control knob is inserted through a main control knob 9 which has a link 95 coupled thereto. The opposite end of the link 95 is connected to the flap valve 81 through a pull rod 82. Therefore, rotating the main control knob 9 causes the flap valve 81 to be lifted from place so that water can be discharged out of the water tank 1. The main control knob 9 has a stub rod 91 at one side opposite to the link 95. The auxiliary control knob 92 has a curved groove 93 at a suitable location. During assembly process, the auxiliary control knob 92 is inserted through the main control knob 9 permitting the stub rod 91 on the main control knob 9 to movably engage into the curved groove 93 on the auxiliary control knob 9 does not carry the auxiliary control knob 92 to rotate. When the main control knob 9 is rotated, the water contained out of the water tank 1 for washing the discharged out of the water tank 1 for washing the lavatory bowl of the flushing system in which the water tank 1 is installed. If the auxiliary control knob 92 is rotated, the main control knob 9 will be carried to rotate causing the flap valve 81 to be lifted while the link 94 is pulled to move the spring plate 6 via the chain 61. When the spring plate 6 is pulled by the link 94 through the chain 61, the rocker arm 3 is pulled by the spring plate 6 from a tilted position to a vertical position and temporarily retained by the clamp 22 at such a vertical position. When the rocker arm 3 is pulled from a tilted position to a vertical position, its hooked portion 31 is simultaneously disconnected from the hooked portion 41 on the float 4, and therefore, the float 4 is released from the constrain of the rocker arm 3 and permitted to follow the flushing water moving downwards. While moving downwards, the bottom sloping edge of the float 4 presses on the bottom edge of the rocker arm 3 causing it to escape from the clamp 22. Because the rocker arm 3 is made in such a manner that the upper part thereof is heavier than the lower part thereof, it will automatically return to its original tilted position when it is released from the clamp 22. As soon as the float 4 moves downwards to a fixed level, its projecting strip 42 will press on the side strip 71 of the resilient cover plate 7 causing it to open the hole 83 on the siphon tube 8. When the hole 83 on the siphon tube 8 is opened, the siphonage is destroyed, and therefore, water is stopped from discharging out of the water tank 1 (see FIG. 4). When water level in the water tank 1 falls off, the water supply valve 5 which is controlled by a float bowl 51 is simultaneously opened to let water from a water supply flow into the water tank 1. As soon as the water tank 1 is fully filled with fresh water, the float 4 is carried upwards to its original position in engaging with the rocker arm 3.

What is claimed is:

1. A dual flushing system for use with a siphon tube having an outlet valve for controlling flow of flush water from a toilet tank through said valve into a toilet bowl, said siphon tube being located in said tank above said valve, the improvement comprising:

a floater holder secured to said siphon tube, said float holder having a guide hole defined therein a rocker arm pivoted to said float holder said rocker arm having a heavier part above the pivot and a hooked portion;

a float received in said guide hole inside said float holder, said float having a projecting strip at the top and a hooked portion spaced from said projecting strip and engaged with the hooked portion on said rocker arm;

a resilient cover plate attached to said siphon tube at one side to seal off a hole on said siphon tube, said resilient cover plate having a side strip at one side;

a spring plate secured to said siphon tube, said spring plate being fixed at one end to said siphon tube and having, a free opposite end disposed above said siphon tube, a main control knob fastened in the water tank at the outside, said main control knob having a first link coupled thereto and a stub rod at an outer side, said first link being connected to said flap valve through a pull rod;

an auxiliary knob fastened in the water tank at the outside and inserted through said main control knob, said auxiliary knob having an axle coupled with a second link and a curved groove at an inner side into which said stub rod is movably engaged, said second link being connected to said spring plate near said opposite end wherein rotating said main control knob causes said flap valve to be lifted for completely draining off the water out of the water tank; rotating said auxiliary control knob causes said spring plate to move said rocker arm from engagement with said float and simultaneously causes said main control knob to lift said flap valve permitting the water in the tank to begin to be discharged out of the water tank, said float will begin to drop with the receeding water level to a point where it will engage said side strip causing said resilient cover plate to open said hole to thus break the siphon and only allow a reduced amount of flush water to flow into said bowl.

* * * * *